United States Patent [19]

Wilson

[11] Patent Number: 4,679,725

[45] Date of Patent: Jul. 14, 1987

[54] END CLOSURE LOCK

[75] Inventor: Jerry F. Wilson, West Monroe, La.

[73] Assignee: Manville Sales Corporation, Denver, Colo.

[21] Appl. No.: 846,826

[22] Filed: Mar. 13, 1986

Related U.S. Application Data

[63] Continuation of Ser. No. 577,108, Feb. 6, 1984, abandoned.

[51] Int. Cl.[4] ..... B65D 75/52

[52] U.S. Cl. ..... 229/40; 206/427; 206/434; 229/48 R

[58] Field of Search ..... 229/40, 48 R; 206/427, 206/434, 140

[56] References Cited

U.S. PATENT DOCUMENTS

| | | | |
|---|---|---|---|
| 3,674,137 | 7/1972 | Graser | 229/40 |
| 3,835,988 | 9/1974 | Buttery | 229/40 X |
| 3,894,681 | 7/1975 | Arneson et al. | 229/40 X |
| 3,945,560 | 3/1976 | Harrelson et al. | 229/40 |
| 4,049,189 | 9/1977 | Wood | 229/40 X |
| 4,155,449 | 5/1979 | Bryne | 206/427 |
| 4,184,626 | 1/1980 | Graser et al. | 206/434 X |
| 4,386,699 | 6/1983 | Sutherland | 229/40 X |
| 4,437,606 | 3/1984 | Graser | 229/40 |

*Primary Examiner*—William Price
*Assistant Examiner*—Gary E. Elkins
*Attorney, Agent, or Firm*—John D. Lister; Cornelius P. Quinn; Timothy R. Schulte

[57] ABSTRACT

A wrap-around sleeve style carrier is provided with end panel punch style tabs designed to interlock the end panels and to prevent the accidental interlocking of the carrier with adjacent carriers or objects.

4 Claims, 8 Drawing Figures

END CLOSURE LOCK

This application is a continuation of Ser. No. 06/577,108 filed 02/06/84, now abandoned.

BACKGROUND OF THE INVENTION

The present invention relates to wrap-around sleeve style carriers and in particular to an end panel interlocking means for such carriers which is designed to prevent the accidental interlocking of adjacent carriers.

Wrap-around sleeve style carriers previously marketed have been provided with punch style locking tabs on an inner end panel and complementary locking openings on an outer end panel for interlocking the overlapping end panels together. To lock the overlapping end panels together, the heads of the punch locking tabs must be inserted not only through the complementary locking openings of the outer end panel but also through openings in the inner end panel. Without such openings in the inner end panel, the head of the locking tabs could not pass through the locking openings of the outer end panels. The openings in the inner end panel are created by the voids left when the punch style locking tabs are folded out of the inner end panel. The contours of these locking tabs below the head portions are designed to leave openings in the inner panel wider than the head portions of the locking tabs. However, the contours utilized for these locking tabs leave protrusions on the outside of the end panels that can interlock with adjacent end panels of other carriers under some circumstances. When an interlocking of such carriers occurs it causes consumer complaints and can result in a tearing of the end panels.

The preset invention solves the problems of the prior art locking systems by providing a punch style locking tab that eliminates the protrusions of the previous punch style locking tabs while still providing relief means on the inner end panel to facilitate the insertion of the punch style locking tab into the complementary opening of the outer end panel and back through the inner end panel.

DETAILED DESCRIPTION OF THE INVENTION

Figure 1:
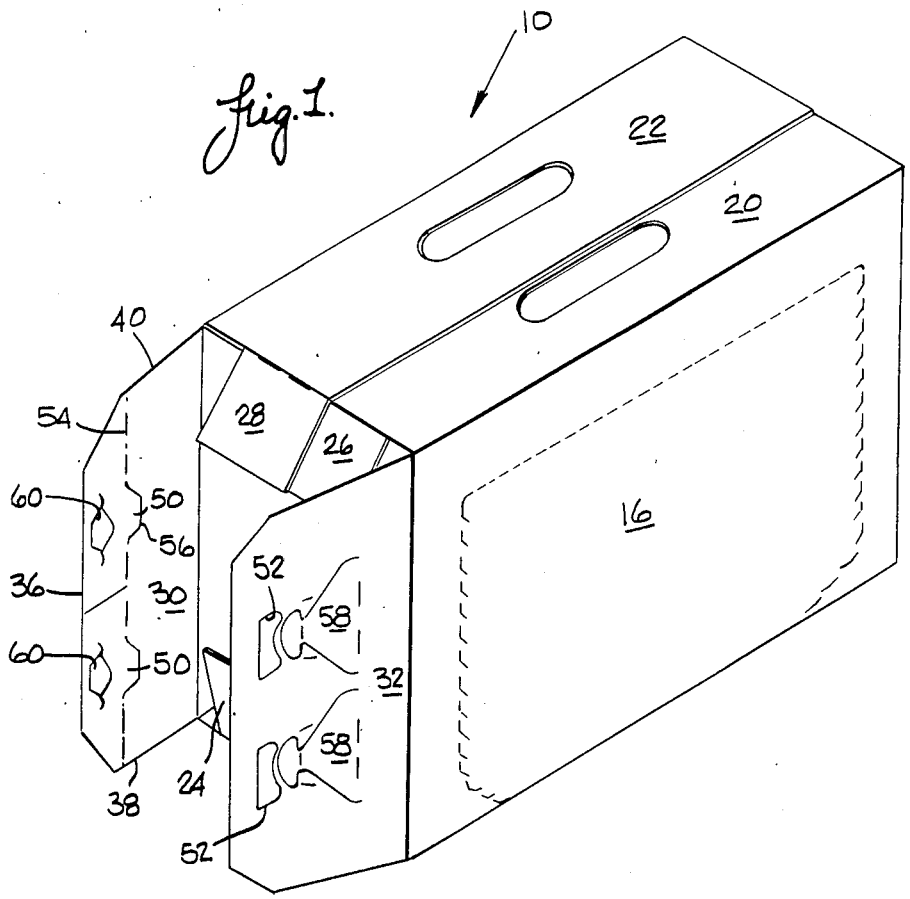
FIG. 1 is a perspective view of a carrier using the locking system of the present invention prior to the locking operation.
Figure 5:
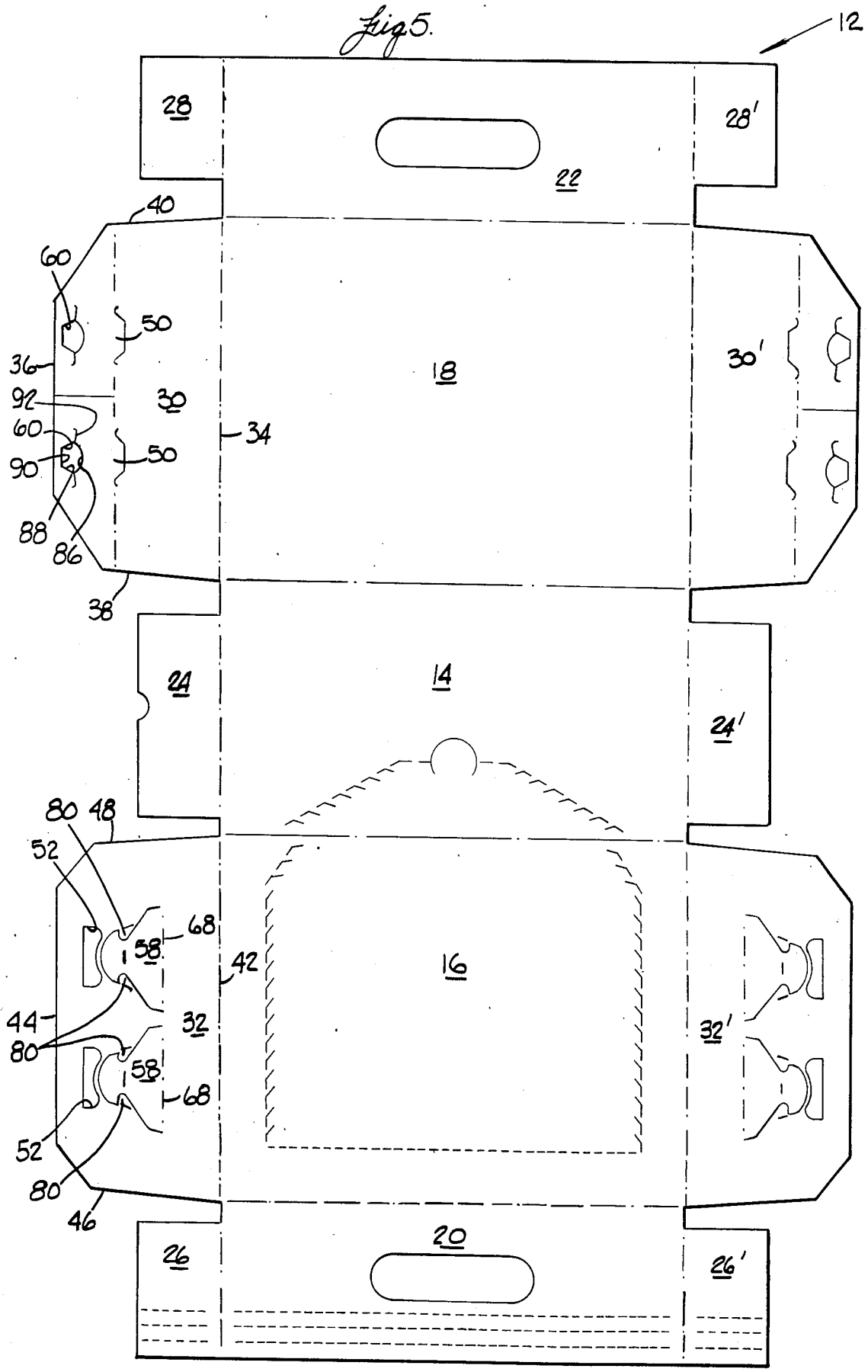
FIG. 5 is a plan view of the production blank for the carrier of FIG. 1.

FIG. 1 illustrates a typical wrap-around sleeve style paperboard carrier 10 which employs the punch tab locking construction of the present invention. As best shown in FIG. 5 the carrier 10 is formed from a blank 12 which comprises a bottom panel 14; side panels 16 and 18; overlapping top panels 20 and 22; dust flaps 24, 24', 26, 26' and 28, 28'; first end panels 30, 30' and second end panels 32, 32'. First end panels 30 and 30' are identical and second end panels 32 and 32' are identical. Accordingly, only first end panel 30 and second end panel 32 and the locking structure on those panels will be described in detail.

First end panel 30 is defined by a score line 34 which hingedly joins the end panel to side panel 18; a free edge 36 opposite the score line 34; and side edges 38 and 40 which extend between the score line 34 and the free edge 36. The end panel 30 is tapered with the side edges 38 and 40 converging toward each other as they approach the free edge 36.

Second end panel 32 is defined by a score line 42 which hingedly joins the end panel to side panel 16; a free edge 44 opposite the score line 42; and side edges 46 and 48 which extend between the score line 42 and the free edge 44. The end panel 32 is tapered with the side edges 46 and 48 converging toward each other as they approach the free edge 44. With this construction, if the carrier is skewed somewhat out of square for some reason, the end panels 30 and 32 will not protrude beyond the top panels 20 and 22 or the bottom panel 14 where they can catch on another carrier or object.

The end panel 30 is provided with a pair of primary locking tabs 50 which interlock with a pair of complementary locking openings 52 on end panel 32 when the end panels are locked together. The bases of the primary locking tabs 50 are aligned with score line 54 but the tab bases are not scored. The tabs 50 are tapered toward their free ends 56 to facilitate the insertion of the tabs into primary locking openings 52. The widths of the primary locking openings 52 are somewhat greater than the widths of the primary lockings tabs 50 at their bases to permit the locking tabs 50 to be fully inserted into the openings.

The end panel 32 is provided with a pair of secondary punch locking tabs 58 which interlock with a pair of complementary secondary locking openings 60 on the end panel 30 when the end panels are locked together. Each secondary punch locking tab 58 comprises a head portion 62, a neck portion 64 and a body portion 66. The base of the body portion 66 is hingedly connected to end panel 32 along a skip-cut 68 which extends parallel to score line 42. The body portion 66 is tapered in the direction of the neck portion 64 with the side edges 70 of the body portion extending in a straight line from adjacent the base to the neck portion 64.

The neck portion 64 is hingedly connected to the body portion by a skip-cut 72 which extends parallel to skip-cut 68 and score line 42. The side edges 74 of the neck portion extend perpendicular to the score line 42.

The head portion 62 is defined by a pair of inner edges 76 which extend out from the neck portion and parallel to the score line 42 and a substantially semicircular outer edge 78 which extends between inner edges 76.

Adjacent and on either side of the neck portion 64 are a pair of relief tabs 80. The relief tabs extend between the head portion 62 and the body portion 66 of the secondary punch locking tab 58. Each relief tab 80 is defined by part of the body portion edge 70; the neck portion edge 74, the inner edge 76 of the head portion; a cut 82 extending out from and in line with the inner edge 76; and a skip-cut 84 extending between the outer end of skip-cut 82 and the body portion edge 70. When the relief tabs 80 are folded back they provide an opening wider than the head portion of the secondary punch locking tab 58.

The secondary locking openings 60 on end panel 30 are each defined by a convex inner edge 86, a straight outer edge 90 and side edges 88 which converge toward the straight outer edge 90. A pair of outwardy extending slits or cuts 92 are located at the junctures between the inner convex edge 86 and the side edges 88. Each opening 60 is wider at the juncture between the inner convex edge 86 and the side edges 88 than the width of the neck portion 64 of the secondary punch locking tab but narrower than the neck portion at the junctures between side edges 88 and outer edge 90. The cuts 92 extend out from the opening 60 to a width greater than the width of the head portion 62 of the secondary punch locking tab 58.

Figure 2:
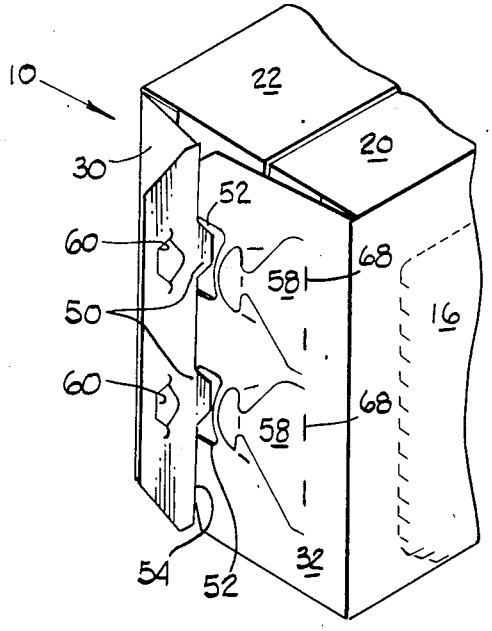
FIG. 2 is a partial perspective view of the carrier of FIG. 1 showing primary locking tabs of a first end panel engaged in complementary openings of the second end panel; 1 showing the end panels overlapped and fully interlocked with secondary punch style locking tabs of the second end panel engaged in complementary secondary female openings of the first end panel.
Figure 3:
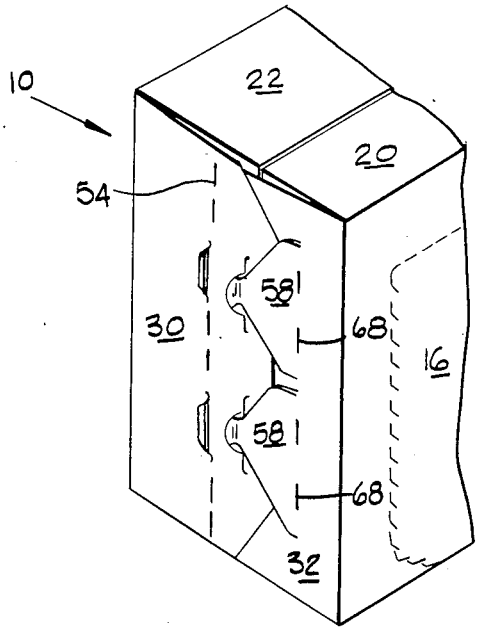
Figure 6:
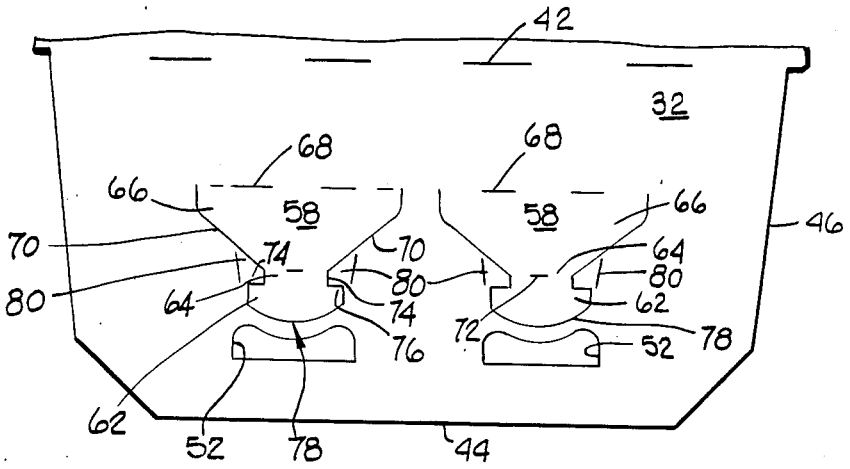
FIG. 6 is a fragmentary view of the production blank to show the punch style locking tab and adjacent portions of the end panel in greater detail.

The locking sequence for locking the end panels 30 and 32 together comprises first engaging the primary locks to initiate the interlocking of the end panels and then engaging the secondary locks to complete the interlocking of the end panels. As shown in FIG. 1 the dust flaps 24 and 26, 28 are folded inward. Then end panel 32 is folded inward as shown in FIG. 2 to overlay the dust flaps. The end panel 30 is folded inward to partially overlay end panel 32 and the outer portion of the end panel 30 is folded back along score line 54 to cause the primary locking tabs 50 to project inwardly. The primary locking tabs 50 are inserted into the primary locking openings 52 of the end panel 32 and as the outer portion of the end panel 30 is folded inwardly to overlay the end panel 32 as shown in FIG. 3 the primary locking tabs 50 are interlocked the under end panel 32. Prior to the folding of the outer portion of end panel 30 to overlay the end panel 32, secondary punch locking tabs 58 are folded outward from the end panel 32 along skip-cut lines 68 so that the punch locking tabs clear the outer portion of the end panel 30 as it is folded inward to overlay the end panel 32. After the outer portion of the end panel 30 is folded to overlay the end panel 32, the heads 62 of the punch locking tabs 58 are punched through the secondary locking openings 60 of the end panel 30 and through the openings in the end panel 32 left by the punch locking tabs 58. The relief tabs 80 fold inwardly along ski-cut lines 84 when contacted by the heads 62 of the punch locking tabs and accordingly, do not interfer with the insertion of the punch locking tabs and the interlocking of the punch locking tabs 58 and the locking openings 60.

As shown in FIG. 3, after the locking sequence is completed, the punch locking tabs 58 have no projections to interlock with or catch on other carriers or objects. This is a result of locating the relief tabs 80 on the end panel 32.

Figure 7:
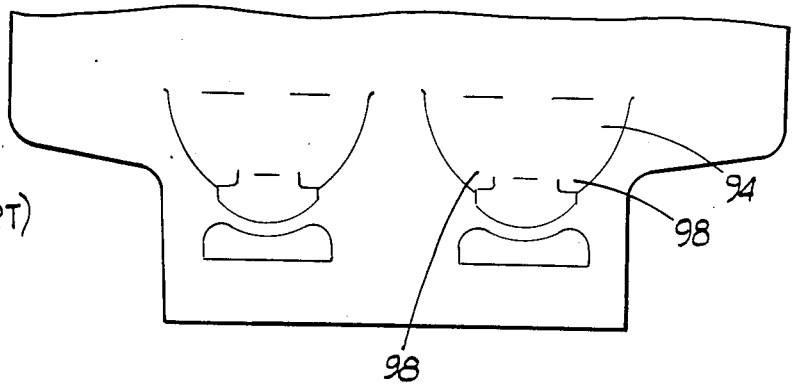
Fig. 7. (PRIOR ART)
FIG. 7 is a fragmentary view of one prior art punch style locking tab.
Figure 8:
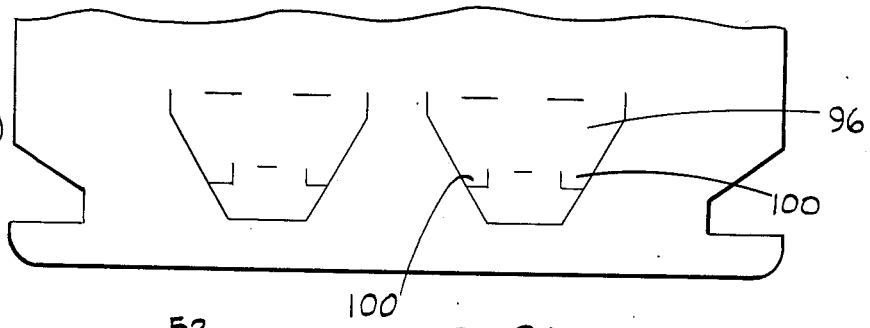
Fig. 8. (PRIOR ART)
FIG. 8 is a fragmentary view of a second prior art punch style locking tab.
Figure 4:
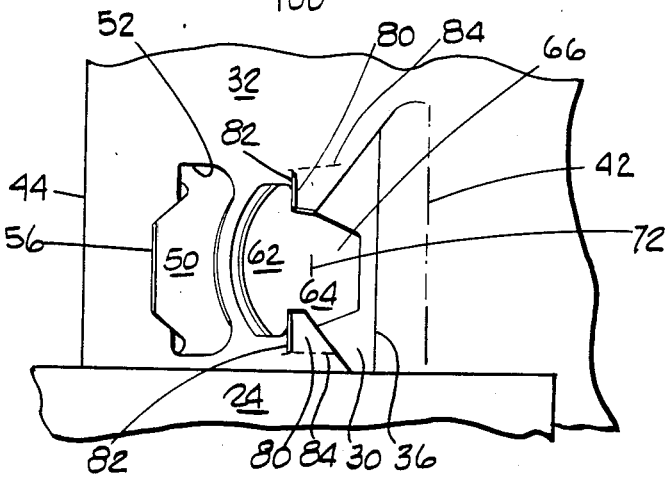
FIG. 4 is a partial view of the inside of the carrier end panels with the panels fully interlocked as shown in FIG. 3.

FIGS. 7 and 8 illustrate prior art secondary punch locking tabs 94 and 96. These secondary punch locking tabs include projections 98 and 100 on either side of the neck portions of the punch locking tabs. With this construction, when the secondary punch locking tabs are inserted into the secondary locking openings, the projections 98 and 100 are exposed to the outside of the carrier where they can catch on other carriers or objects.

What I claim is:

1. A wrap-around sleeve style carrier comprising:

a bottom panel, two side panels, and a top panel;

two pairs of end panels hingedly joined to opposite ends of said side panels along fold lines to close the ends of said carrier, each pair of end panels comprising a first end panel and a second end panel, said first end panel having a primary locking means comprising two spaced apart locking tabs and a secondary locking means comprising two spaced apart locking openings, said first end panel further having slits extending outwardly from opposite sides of each locking opening at the widest part thereof, the slits extending in the general direction of said fold lines, said second end panel having a primary locking means comprising two spaced apart locking openings adapted to receive said primary locking tabs and a secondary locking means comprising two spaced apart punch locking tabs, each of said punch locking tabs having a head portion adapted to be punched through one of said secondary locking openings and a tapered body portion hingedly joined at a base to said second end panel along a fold line and connected to said head portion through a neck portion, the width of the neck portion being less than the width of a secondary locking opening at the widest part thereof and the width of the head portion being less than the combined width of a secondary locking opening at the widest part thereof and the lengths of the slits extending therefrom, said tapered body portion having edges converging from adjacent the base of said tapered body portion to said neck portion, said head portion having edges extending outwardly from said neck portion which are adapted to engage the inside of the first end panel adjacent said secondary openings to prevent said punch tabs from pulling out of said secondary openings, and said second end panel having two relief tabs on either side of each of said neck portions to facilitate the insertion of said punch tabs into said secondary openings, said relief tabs extending between said converging edges of said body portion and said edges of said head portion, said relief tabs being hingedly joined to said second end panel along fold lines extending from said converging edges of said body portion toward said edges of said head portion, and said first end panel at least partially overlapping said second end panel with said primary locking tabs engaged in said primary openings and said secondary male punch tabs extending over said first end panel and engaged in said secondary openings to lock the end panels together.

2. A wrap-around carrier as defined in claim 1 wherein each of said pairs of fold lines joining said relief tabs to said second end panel are spaced out from and converge toward said head portions.

3. A wrap-around carrier as defined in claim 1 wherein each of said end panels is tapered from said fold line joining said end panel to said side panel to a free edge opposite said fold line.

4. A production blank for a wrap-around sleeve style carrier comprising:

a bottom panel, a first side panel, a second side panel and a top panel;

a first pair of end panels hingedly joined to opposite ends of said first side panel along a first pair of fold lines;

a second pair of end panels hingedly joined to opposite ends of said second side panel along a second pair of fold lines;

said first pair of end panels each having a primary locking means comprising two spaced apart locking tabs and a secondary locking means comprising two spaced apart locking openings, said first pair of end panels further having slits extending outwardly from opposite sides of each of the locking openings at the widest part thereof, the slits extending in the general direction of the first pair of fold lines; and said second pair of end panels each having a primary locking means comprising two spaced apart locking openings adapted to receive said primary locking tabs and a secondary locking means comprising two spaced apart punch locking tabs, each of said punch locking tabs having a head portion adapted to be punched through one of said secondary locking openings and a tapered body portion hingedly connected at a base to said end panel along a fold line and connected to said head portion through a neck portion, the width of the neck portion being less than the width of a secondary locking opening at the widest part thereof and the width of the head portion being less than the combined width of a secondary locking opening at the widest part thereof and the lengths of the slits extending therefrom, said tapered body portion having edges converging from adjacent said base of said tapered body portion to said neck portion, said head portion having edges extending from said neck portion, and two relief tabs on either side of each of said neck portions, said relief tabs extending between said converging edges of said body portion and said extending edges of said head portion, and said relief tabs being hingedly connected to said respective end panel along fold lines extending from said converging edges of said body portion toward said head portion.

* * * * *